United States Patent [19]

Peraino

[11] Patent Number: 4,745,839

[45] Date of Patent: May 24, 1988

[54] DRUM MUTE

[76] Inventor: Victor Peraino, 28525 Selkirk, Southfield, Mich. 48076

[21] Appl. No.: 3,628

[22] Filed: Jan. 15, 1987

[51] Int. Cl.[4] ..... G10D 13/02

[52] U.S. Cl. ..... 84/411 M

[58] Field of Search ..... 84/411 R, 411 A, 411 M, 84/411 P, 411–422

[56] References Cited

U.S. PATENT DOCUMENTS

| | | | |
|---|---|---|---|
| 635,192 | 10/1899 | Sapp | 84/411 A |
| 1,579,893 | 4/1926 | Simpson | 84/411 M |
| 2,078,004 | 4/1937 | Lebow | 84/411 P |
| 2,285,269 | 6/1942 | Grolimund | 84/415 |
| 2,445,486 | 7/1948 | La Londe | 84/422 R |
| 4,048,895 | 9/1977 | May | 84/411 A |
| 4,242,937 | 1/1981 | Pozar | 84/411 R |
| 4,246,825 | 1/1981 | Hodas | 84/415 |
| 4,377,964 | 3/1983 | Glassford | 84/411 R |
| 4,519,288 | 5/1985 | Aluisi | 84/411 M |

*Primary Examiner*—Lawrence R. Franklin

*Attorney, Agent, or Firm*—Charles W. Chandler

[57] ABSTRACT

A drum mute used to dampen a drum and remove unwanted ringing overtones is installed on the inside of the drum in contact with the drum skin and supported in position by a mounting rod having its ends spanning the drum body, the midsection of the mounting rod engaging the drum mute to support it in position. The drum mute may be either an inflatable member or a resilient foam member.

11 Claims, 1 Drawing Sheet

DRUM MUTE

BACKGROUND OF THE INVENTION

This invention is related to a cushioned drum mute mounted on the inside of the drum and supported in contact with the center of the drum skin.

Drum mutes are commonly employed for altering the sound produced by a drum.

One type of device, known as a muffler, is illustrated in U.S. Pat. No. 4,338,850, which issued to Albert E. Payson on July 13, 1982. This muffler includes a supple material. One or more elastic strips maintain the supple material in a contiguous relationship to the drum head. A cord is situated to selectively withdraw successive portions of the supple material from the drum head to alter the degree of muffling produced. The supple material may be felt, fur or other soft flexible material.

SUMMARY OF THE INVENTION

The broad purpose of the present invention is to provide an improved drum mute in which a cushion member is mounted on the inside of the drum skin that is struck with a striking instrument. In the preferred embodiment the cushion member comprises an inflatable member supported in contact with the drum skin by a rod having its ends spanning the interior of the drum body and its midsection engaged with the cushion to support it in position. The mounting rod may be adjusted to vary the amount of pressure the cushion applies to the drum skin.

In another embodiment of the invention, the cushion member comprises a resilient urethane body supported in contact with the drum skin by the mounting rod. Preferably the cushion member is about one-half the diameter of the drum skin, however, it may be made in a variety of sizes varying from about 5 inches to 20 inches in diameter and about 1 inch to 18 inches in thickness.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
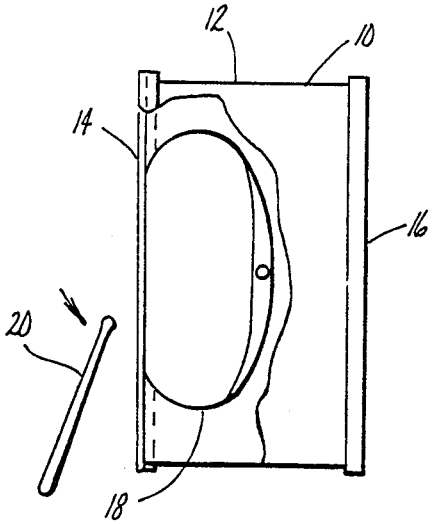
FIG. 1 is a partially sectional view through a drum having a mute illustrating the preferred embodiment of the invention.

Referring to the drawing, FIG. 1 illustrates a musical percussion drum 10 having a cylindrical body 12, a conventional drum skin 14 mounted at one end of the body, and a second drum skin 16 mounted at the opposite end of the body.

Figure 2:
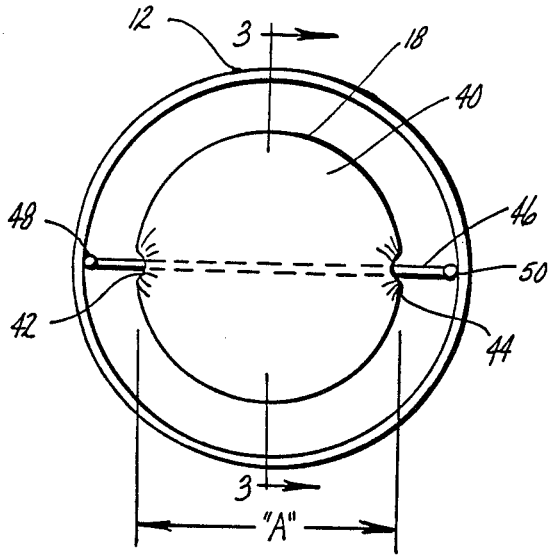
FIG. 2 is an internal sectional view of the drum and mute of FIG. 1.
Figure 3:
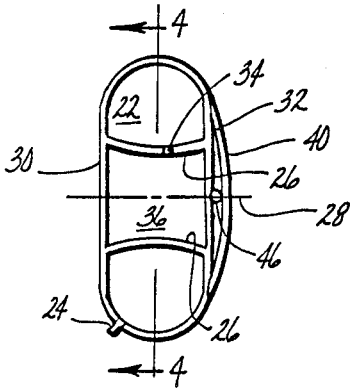
FIG. 3 is an enlarged sectional view of the inflatable mute.

Drum mute 18 is mounted in the drum body adjacent drum skin 14 which in practice, is struck by a striking member 20. Drum mute 18, as viewed in FIG. 2, has a circular configuration with a diameter "A" approximately one-half the internal diameter of the drum body. The drum mute is supported in a central position against drum skin 14. The mute is preferably formed of a flexible vinyl material having an interior air-tight annular chamber 22. Valve member 24 is employed for introducing air to a selected pressure into the mute. The air pressure is chosen according to the degree of sound alteration desired.

Figure 4:
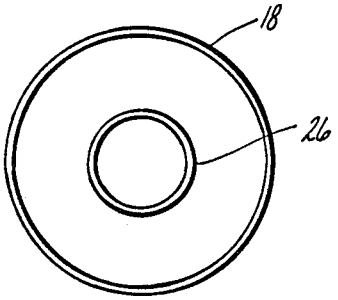
FIG. 4 is a sectional view of the mute as seen along lines 4—4 in FIG. 3.

As viewed in FIG. 4, an interior, annular wall 26,is mounted within the mute about a central axis 28 and is attached to both front face 30 and rear face 32 of the mute. The outer wall of the mute is also formed about the same axis. Annular wall 26 has a series of air holes, such as at 34, so that as air is introduced into chamber 22, air also is introduced within the interior of chamber 36 formed by wall 26. Wall 26 functions to prevent the front and back faces of the mute from bulging to an undesirable position.

Front face 30 of the mute is held in contact with drum skin 14. The rear face has a fabric skin 40 having a pair of openings 42 and 44. Mounting rod 46 is passed through openings 42 and 44 and has a pair of ends 48 and 50 which frictionally engage the interior of the drum body to hold the mounting rod in position. The mounting rod can be mounted in an adjusted position to apply a selective amount of pressure by the cushion against drum skin 14. Preferably the cushion is mounted in a central position with respect to drum skin 14. Other means can be employed for supporting the mute in contact with the drum skin, without using rod 46. For example, the mute could be such a size as to be sandwiched in contact with both drum skin 14 and drum skin 16, and suspended in position by the two drum skins without a supporting rod, or the mute could be supported either by straps or a second skin or member attached to the drum body.

Figure 5:
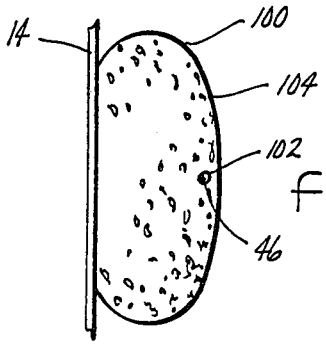
FIG. 5 is a sectional view of a foam mute.

FIG. 5 illustrates another cushion member 100 which may also be held in contact with drum skin 14 by mounting rod 46, however, in this case the cushion is formed of a resilient polyurethane foam having generally the same diameter and thickness of the inflatable drum mute illustrated in FIGS. 1–4. The mounting rod is passed through an opening 102 that is spaced from the back face 104 of the mute.

The mute, whether inflatable or of foam can take other suitable shapes, such as a donut shape, as long as it is in contact with at least one drum skin.

Having described my invention, I claim:

1. A combination comprising:

a percussion musical instrument having a hollow body with an opening, and a flat skin stretched over said opening;

mute means for altering the tones of the instrument when the skin is struck by a striking member, including:

an inflatable cushion member disposed in the drum;

the inflatable cushion member having a pair of opposed sides including a first side disposed in contact with the drum skin and a second side; and a mounting rod having a midsection and a pair of opposite ends, the midsection being connected to the inflatable cushion member and said opposite ends being releasably mounted against opposite sides of the hollow body so as to support the inflatable cushion member in contact with the drum skin.

2. A combination as defined in claim 1, in which the inflatable cushion member has an annular wall defining an annular air chamber.

3. A combination as defined in claim 1, in which the inflatable cushion member has an internally disposed annular wall connecting said first and second sides so as to prevent the first side from bulging with respect to the second side when the inflatable cushion member is inflated.

4. A combination as defined in claim 1, in which the inflatable cushion member has an annular outer wall formed around a first axis, and including an inner annular wall formed around said first axis.

5. The combination as defined in claim 1, including means for connecting the mounting rod to the inflatable cushion member comprising a fabric skin attached to the cushion member and having a pair of openings for receiving the mounting rod therethrough.

6. The combination as defined in claim 1, in which the mounting rod is adapted to be adjustably mounted within the hollow body so as to adjust the amount of pressure applied by inflatable the cushion member on the drum skin.

7. A combination as defined in claim 1, including means for inflating the cushion member to a selected pressure.

8. A combination as defined in claim 1, in which the cushion member has a diameter approximately one-half the diameter of the drum skin.

9. A combination as defined in claim 1, in which the cushion member has a diameter less than that of the drum skin, and is disposed against the drum skin so as to be spaced from the entire border of the drum skin.

10. A combination comprising:

a percussion musical instrument having a hollow body with an opening, and a flat skin stretched over said opening;

mute means for altering the tones of the instrument when the skin is struck by a striking member including:

an inflatable cushion member disposed in the drum;

a mounting rod disposed in the hollow body generally parallel to the skin and having opposite ends frictionally engaged with opposite sides of the body interior an adjusted distance with respect to the skin, the rod being connected to the inflatable cushion member to support same in an adjusted position along the rod between the interior body sides supporting the rod to bias the skin of the musical instrument with a bias depending upon said adjusted distance.

11. A combination comprising:

a percussion musical instrument having a hollow body with an opening, and a flat skin stretched over said opening, the skin having a striking area suited to be struck by a striking instrument;

mute means for altering the tones of the instrument when the skin is struck by a striking member, including:

a resilient foam cushion member having a diameter less than that of the drum interior;

mounting means for supporting said resilient foam member in contact with the interior of the drum skin adjacent said striking area, said mounting means including a mounting rod disposed in the hollow body generally parallel to the skin, the mounting rod having opposite ends frictionally engaged with opposite sides of the body interior an adjusted distance with respect to the skin, means connecting the rod to the cushion member to support same in an adjusted position along the rod between the interior body sides supporting the rod to bias the skin of the musical instrument with a bias depending upon said adjusted distance.

* * * * *